US005237299A

United States Patent [19]

Chandler et al.

[11] Patent Number: 5,237,299

[45] Date of Patent: Aug. 17, 1993

[54] ANTI-MICROPHONIC CAVITY STRUCTURE TUNING APPARATUS

[75] Inventors: Kirk R. Chandler, Garland; Mark L. Ryland, Allen, both of Tex.

[73] Assignee: Alcatel Network Systems, Inc., Richardson, Tex.

[21] Appl. No.: 872,779

[22] Filed: Apr. 23, 1992

[51] Int. Cl.[5] ..... H01D 7/00

[52] U.S. Cl. ..... 333/233; 333/235

[58] Field of Search ..... 333/222–227, 333/231, 232, 235; 331/96, 107 DP, 117 D

[56] References Cited

U.S. PATENT DOCUMENTS

| | | | |
|---|---|---|---|
| 4,035,749 | 7/1977 | Slocum et al. | 333/232 |
| 4,491,806 | 1/1985 | Reynolds et al. | 331/96 |
| 4,647,883 | 3/1987 | Oxley | 333/232 X |

*Primary Examiner*—Robert J. Pascal

*Assistant Examiner*—Seung Ham

*Attorney, Agent, or Firm*—Bruce C. Lutz; Dennis O. Kraft

[57] ABSTRACT

A concept previously used for providing anti-rotational locking of complementary threaded devices is utilized in a RF tuning cavity to minimize anti-microphonic disturbances of the prior art caused by inconsistent ohmic contact between the prior art adjustable length threaded portions. The use of a resilient locking strip embedded longitudinally into the threads of an adjustable resonator provides substantially constant electrical or ohmic contact between the two threaded portions so as to maintain a standing wave in the tuning element. The longitudinal design of the locking strip is such as to prevent or minimize movement of the extremity of the threaded resonator which movement can also effect the resonant frequency.

4 Claims, 1 Drawing Sheet

ANTI-MICROPHONIC CAVITY STRUCTURE TUNING APPARATUS

THE INVENTION

The present invention is generally directed towards mechanical resonators. Even more specifically the invention is directed towards a mechanical resonator for mounting in a cavity as part of an RF oscillator in which the resonator needs to be adjusted in length while minimizing microphonic problems occurring under vibratory conditions. Even more specifically, the present invention is concerned with a resilient member inserted into the threads and positioned or mounted parallel to the axis of the threaded adjustable members to maintain electrical continuity between the threaded members both during and after adjustment to length, not only for maintaining the length, but also to prevent microphonics under vibration.

BACKGROUND

Mechanical resonators have long been used in a cavity to simulate a transmission line as part of the reactive impedance for an oscillator. The length of the resonator is adjusted to keep the oscillator oscillating at a given frequency. Prior art resonators needed to have some method of keeping the tuning portion at the given adjusted value once it is set. In other words, the adjustable part of the tuned resonator should not continue rotating due to vibration to other external forces. The typical prior art method of accomplishing this was to foreshorten a portion of the female threads so that one set of threads are slightly out of alignment with the remainder of the female threads thereby creating tension of the male threaded portion. While such an approach kept the male portion from rotating under vibrational situations, it did not prevent intermittent contact under vibration situations. When there is intermittent contact, the effective length of the resonator appears to change from the viewpoint of the connected oscillator. This lack of or intermittent contact is usually the result of vibratory movement of the male portion of the resonator.

SUMMARY OF THE INVENTION

The present invention provides the required constant maintenance of contact between the male and female portions by providing a slot in the male portion, and putting a resilient material such as nylon in the male portion so as to provide a constant pressure between threads of the male portion of the resonator on the opposite side and the female portion of the resonator. This slot is parallel to the axis of the male portion of the resonator, and thus acts to provide the pressure over a considerable length of the male portion and the female portion. Such an action minimizes any movement of the male portion with respect to the female portion. Any movement of the resonator relative to the cavity sidewalls affects the reactive impedance, even though to a much lesser extent than the loss of electrical contact between the male and female portions of the resonator. Thus the present invention provides a substantial improvement in two areas of microphonics problems of the prior art, namely, loss of contact between the male and female portion and movement of the end of the resonator with respect to the cavity sidewalls.

It is thus an object of the present invention to provide an improved prevailing torque approach for use in RF mechanical resonators.

BRIEF DESCRIPTION OF THE DRAWINGS

Other objects and advantages of the present invention will be apparent from a reading of the specification and appended claims in conjunction of the drawings wherein

DETAILED DESCRIPTION

Figure 1:
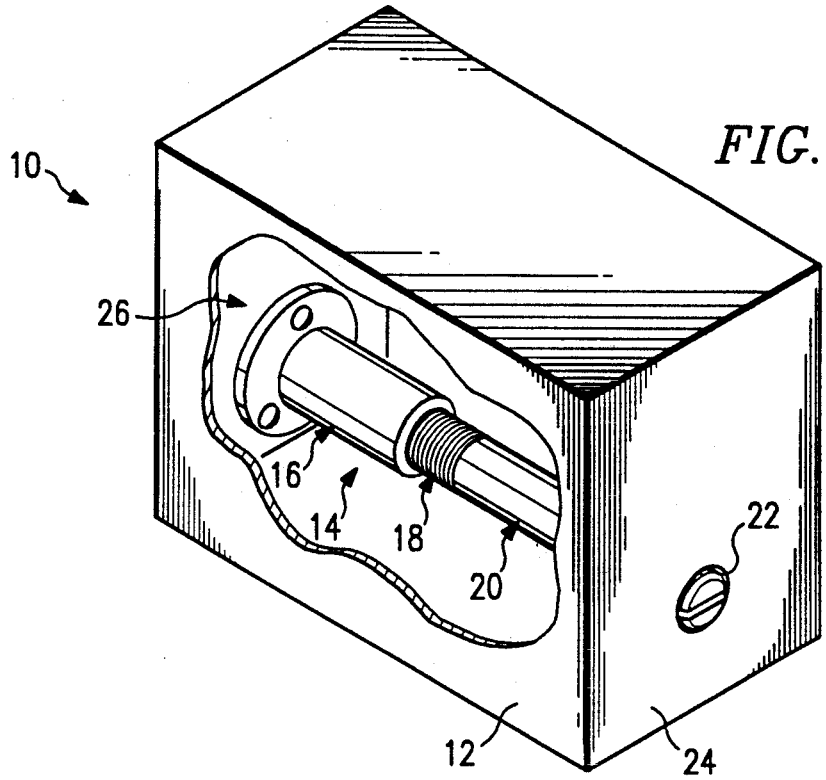
FIG. 1 is an isometric view of a resonator assembled in a cavity.

In FIG. 1 a cavity in the form of a box 10 is illustrated with a cut-out in a face 12 thereof. Within the cavity 10 is shown a resonator generally designated as 14 having a female base portion 16, a male portion 18, and an adjustment portion 20. An end of portion 20 (to be later designated as 64), is shown in an opening 22 in a surface 24 of cavity 10. As will be noted, female portion 16 has a base section (to be later designated as 30), mounted to a further wall 26 of cavity 10. Electrical signals are supplied to the resonator 14 via an opening in wall 26.

Figure 2:
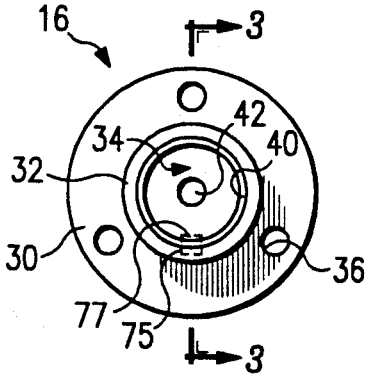
FIG. 2 is a base view of the female portion of a resonator.
Figure 3:
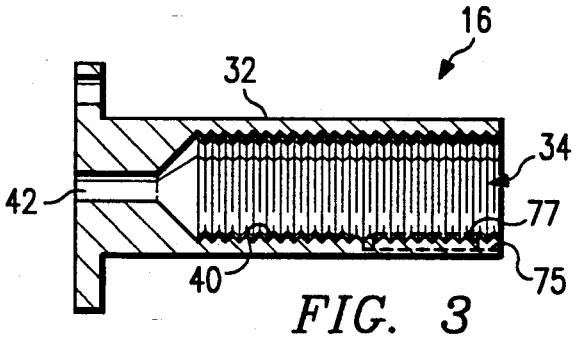
FIG. 3 is a cross-sectional view of FIG. 2.

FIG. 2 illustrates more details as to the base of resonator female portion 16. In FIG. 2, the base is designated as 30 with a cylinder having an outside portion 32 and an inside portion 34. Interior portion 34 is threaded. The base 30 has openings 36 for fastening the base 30 of the female portion of the resonator to wall 26. A cross-section through the device of FIG. 2 is shown in FIG. 3 with threads designated as 40 and illustrating that there is an opening into base 30 from the interior threaded portion 34. This opening is designated as 42. Typically, this opening 42 contains a transistor comprising a portion of an oscillator. The opening extends through to portion 34 to simplify the plating process used to assure electrical contact between mating threads.

Figure 4:
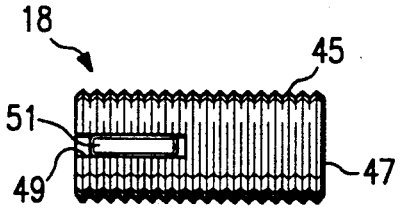
FIG. 4 is a side view of the male portion of the resonator of FIG. 1.

FIG. 4 illustrates in more detail the male portion 18 of FIG. 1. There is shown an outside threaded portion 45 and an end 47. There is also shown a slot 49 and resilient material 51 inserted in the slot 49. The design of the male portion 18 including the resilient material 51 is such that the resilient material 51 typically is nylon, and typically extends to the height of the extremity of the threads on the surface 45. Such a device is of the type made by Nylock's Fastener Corporation at 800 West University Drive, Rochester, Mich. 48063. The "locking" device is typically referred to by Nylock as a strip-locking element. A dash line slot 75 and dashed line imbedded resilient material 77 is illustrated in FIGS. 2 and 3 to show how the material 51 of FIG. 4 could alternatively be used in conjunction with the female threads such as base portion 16 rather than in male portion 18.

Figure 5:
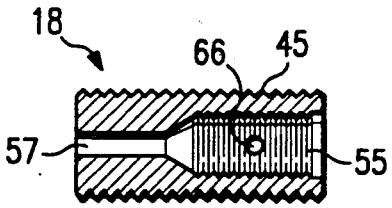
FIG. 5 is a cross-sectional view of FIG. 4.

FIG. 5 shows a cross-section through the center of FIG. 4 and illustrates in addition to threads on the external surface 45, there are further threads 55 in the interior section of the device. Further, there is an opening 57 so that the entire internal portion of element 45 is open. The male portion 18 was designed with an opening 57 to simplify manufacturing.

Figure 6:
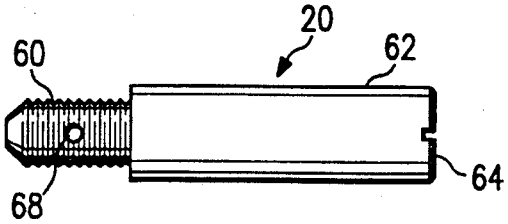
FIG. 6 is a side view of an extension device used in connection with the adjustment of the male portion of FIG. 4 relative to the female portion of FIG. 3.

FIG. 6 comprises an adjustment device which in one embodiment of the inventive concept comprised rexolite since it has a dielectric as close to air as is possible combined with the strength necessary to adjust the locking mechanism posed by nylon 51 in connection with the threads internal to female portion of FIG. 3. As illustrated, the device 20 of FIG. 6 comprises a threaded end 60, and a main body 62 with a slot 64 such as is shown within opening 22 of FIG. 1.

It will be noted that there is an opening 66 in FIG. 5, and a similar opening 68 in the threaded portion 60 of FIG. 6. A force-fit pin (not shown) is driven through the two openings to keep portion 20 from unscrewing from male portion 18 during the adjustment process.

OPERATION

Although the operation of the concept is believed reasonably obvious from the detailed description, a few words are believed in order for summarization.

The longitudinally situated resilient material 51 reacting with threads 40 in female portion 16 causes a pressure on the threads of the backside (a point 180 degrees removed from the slot containing resilient material 51) of male element 18. This pressure is against the threads 40 of female portion 16 (at the same 180 degree removed point). This pressure assures good electrical contact between male portion 18 and female portion 16. One of the problems of the prior art was that this contact or ohmic electrical connection was intermittent and thus the electrical length of the resonator appeared to change to the transistor oscillator and thus the oscillator frequency would attempt to change. The change in apparent length of the resonator may also affect the output power so that a detector (not shown) mounted near resonator 16 would see not only changes in frequency, but also changes in power. The use of a longitudinal strip 51 keeps the pressure over a large number of threads, and prevents movement of the end 47 of male portion 18 with respect to the axis of device 16. The prior art adjustable portions similar to 18 also had this tendency of moving and this movement with respect to the sides of cavity 10 also tended to change the frequency of operation. As previously mentioned device 20 is composed of rexolite and does not substantially affect the frequency of the resonator 14. However, any object within the cavity does affect the frequency, even rexolite. The adjustable portion 20 adds a lever arm to the male portion 18 and vibrational forces can act on this longer lever arm to attempt to move male portion 18. Keeping the opening 22 of a small diameter helps limit this movement, but cannot by itself eliminate same. In some embodiments, the end 64 cannot extend outside the container wall 24 of the cavity, and thus for some adjustments the end 64 would not even reach wall 24 thereby allowing movement beyond the sides of opening 22.

In summary, while we have disclosed one embodiment of the inventive concept, we wish to be limited not by that specific embodiment, but only by the inventive concept of having a resilient member built into the threads of at least one of male and female portions to provide continuous ohmic contact between the two threaded portions in spite of vibrational forces and/or using a resilient member in the threads to minimize the side-to-side movement of the end of male portion 18 extending beyond female portion 16 as described in the appended claims wherein we claim:

1. Adjustable resonator apparatus comprising, in combination:

base portion including electrically conductive female threaded portion lying in a longitudinal axis thereof;

electrically conductive male threaded adjustable portion coacting with the female threaded portion of said base portion to effectively provide an adjustable length signal transmission line; and resilient means, imbedded in a discontinuity of a portion of the threads of at least one of said base and male portions, for maintaining ohmic contact between said male and female threaded portions.

2. Resonator apparatus comprising, in combination:

base portion including female threads lying in a longitudinal axis thereof;

male threaded adjustable means for coacting with the female threads of said base portion to effectively provide an adjustable length signal transmission line; and resilient means, longitudinally imbedded in an opening in the threads of at least one of said base portion and said male threaded means, for minimizing movement at right angles to said longitudinal axis of any portion of said male threaded means extending beyond the female threads of said base portion.

3. Apparatus for maintaining electrical contact between mating threaded section on conductive material comprising, in combination:

female electrically conductive threaded apparatus;

male electrically conductive threaded apparatus, said apparatus having a longitudinal axis centered within threads thereof;

a slot in the threads of one of said female and male apparatus parallel to said longitudinal axis; and resilient material in said slot for maintaining electrical contact between mating threads at a point substantially 180 degrees removed from said slot.

4. Apparatus for minimizing relative movement in a quadrature direction to a longitudinal axis between mating threaded sections comprising, in combination:

circular female threaded apparatus;

circular male threaded apparatus, said male threaded apparatus having a longitudinal axis centered within threads thereof;

a slot in the threads of at least one of said female and male apparatus parallel to said longitudinal axis; and resilient material in said slot for maintaining mechanical contact between mating threads at a point substantially 180 degrees removed from said slot whereby movement of said male threaded apparatus relative said female threaded apparatus in a quadrature direction to the longitudinal axis is minimized.

* * * * *